US007044595B2

(12) United States Patent
Youn

(10) Patent No.: US 7,044,595 B2
(45) Date of Patent: May 16, 2006

(54) APPARATUS TO CONTROL STATIC ELECTRICITY IN AN INK-JET PRINTER

(75) Inventor: Karp-sik Youn, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 2 days.

(21) Appl. No.: 10/608,183

(22) Filed: Jun. 30, 2003

(65) Prior Publication Data

US 2004/0017463 A1 Jan. 29, 2004

(30) Foreign Application Priority Data

Jun. 29, 2002 (KR) ..... 2002-37461

(51) Int. Cl.
*B41J 2/01* (2006.01)

(52) U.S. Cl. ..... 347/104

(58) Field of Classification Search ..... 347/104
See application file for complete search history.

(56) References Cited

U.S. PATENT DOCUMENTS 5,527,123 A * 6/1996 Jackson et al. ..... 400/642
5,805,176 A * 9/1998 Saito et al. ..... 347/8

* cited by examiner

*Primary Examiner*—K. Feggins
*Assistant Examiner*—Julian D. Huffman
(74) *Attorney, Agent, or Firm*—Staas & Halsey LLP

(57) ABSTRACT

An apparatus to control static electricity in an inkjet printer, includes a feeding roller to convey paper being fed from a paper-feeding portion to be placed under a print head; a pinch roller to rotate in contact with the feeding roller; a holder on which a shaft of the pinch roller is rotatably supported; a frame made of a metallic material, to support the holder; and a ground member to ground the pinch roller to the frame, to control the static electricity occurring in the paper passing between the feeding roller and the pinch roller.

8 Claims, 2 Drawing Sheets

APPARATUS TO CONTROL STATIC ELECTRICITY IN AN INK-JET PRINTER

CROSS-REFERENCE TO RELATED APPLICATIONS

This application claims the benefit of Korean Application No. 2002-37461, filed Jun. 29, 2002, in the Korean Intellectual Property Office, the disclosure of which is incorporated herein by reference.

BACKGROUND OF THE INVENTION

1. Field of the Invention

The present invention relates to an apparatus to control static electricity in an ink-jet printer.

2. Description of the Related Art

Generally, an ink-jet printer is provided with a carriage that is reciprocally disposed in a main frame and has an ink-cartridge. The carriage reciprocates by a moving unit, which is supported on a timing belt, and a guide shaft. The ink-cartridge has a print head disposed at a lower portion thereof. The print head is disposed to have a head gap with respect to printing paper that is conveyed by a feeding roller. The print head jets ink onto the paper to print an image on the paper while moving. That is, the print head disposed above and apart from the printing paper by a predetermined distance jets the ink through an ink-jet nozzle, and the jetted ink is transferred to the printing paper to form an image. At this point, a controller of the printer properly controls the ink-jetting operation of the ink-jet nozzle in accordance with input image information.

Static electricity is generated when the paper conveyed from a paper-feeding portion comes into contact with the feeding roller or a guide portion. The static electricity causes improper feeding of the paper and the quality of the printing paper deteriorates.

Also, the static electricity occurs near the print head and may interfere with the driving of the print head. This causes abnormalities in the print head, and thus data is not printed properly.

SUMMARY OF THE INVENTION

Accordingly, it is an object of the present invention to solve the above problems in the related art.

It is another object of the present invention to provide an apparatus for an ink-jet printer to control static electricity that occurs during a conveyance of paper.

Additional objects and advantages of the invention will be set forth in part in the description which follows and, in part, will be obvious from the description, or may be learned by practice of the invention.

The foregoing and/or other objects of the present invention are achieved by providing an apparatus to control static electricity in an inkjet printer, including a print head; a paper-feeding portion from which paper is fed; a feeding roller to convey the paper being fed from the paper-feeding portion to the print head; a pinch roller to rotate in contact with the feeding roller, the pinch roller having a shaft; a holder, the shaft of the pinch roller being rotatably supported on the holder; a frame made of a metallic material, to support the holder; and a ground member to ground the pinch roller to the frame, to control the static electricity occurring in the paper passing between the feeding roller and the pinch roller.

The ground member may be connected to the shaft of the pinch roller and the frame. Also, the ground member may be a metallic wire that has one end connected to the shaft of the pinch roller and the other end connected to the frame. Furthermore, the ground member may be a torsion spring that is disposed around the frame and has one end elastically contacting the pinch roller and the other end elastically contacting the frame. Still further, the pinch roller may be a molded portion including a conductive synthetic resin.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
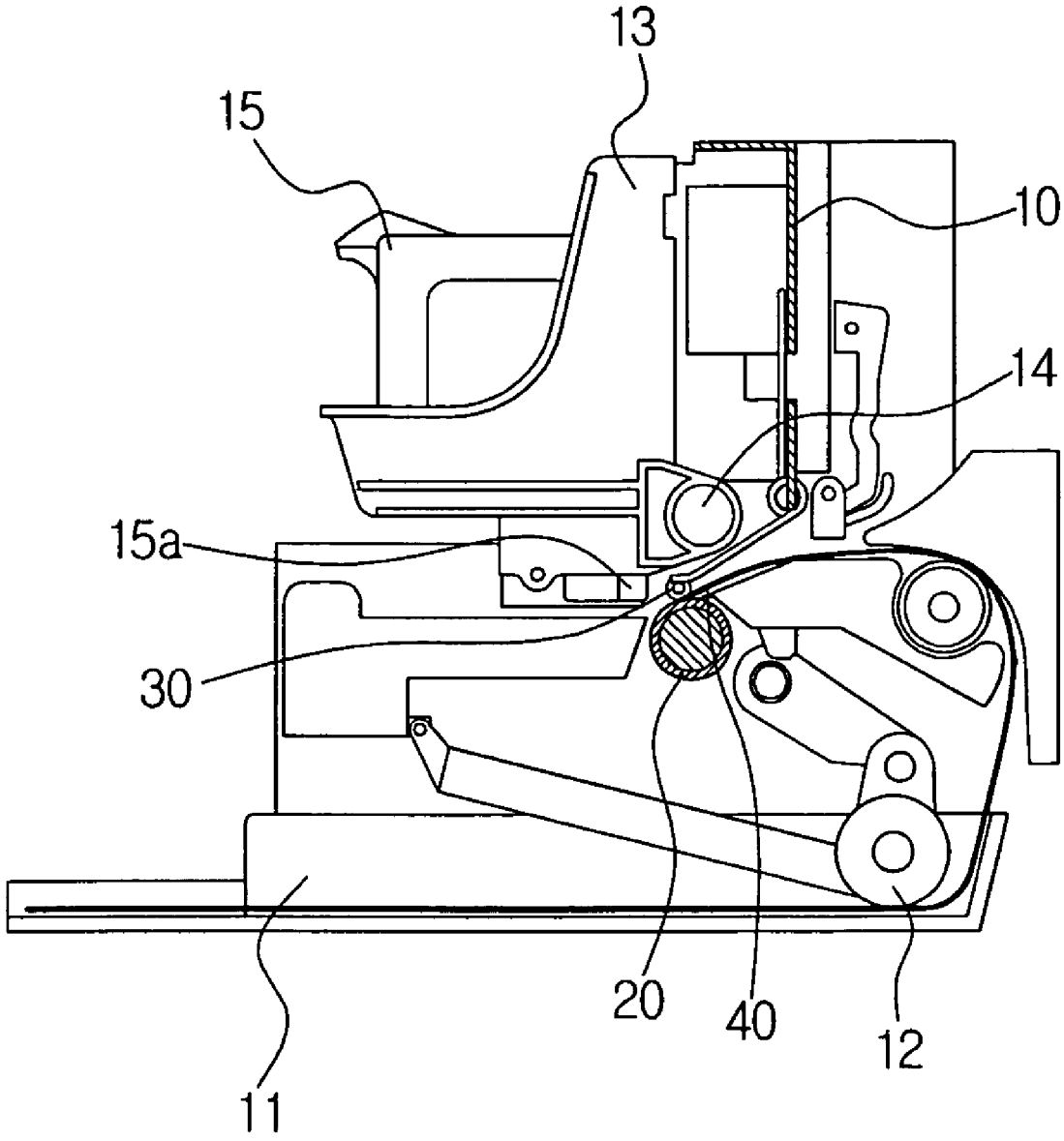
FIG. 1 is a schematic side sectional view showing an apparatus to control static electricity for an ink-jet printer according to the present invention.

Reference will now be made in detail to the present preferred embodiments of the present invention, examples of which are illustrated in the accompanying drawings, wherein like reference numerals refer to like elements throughout.

Figure 2:
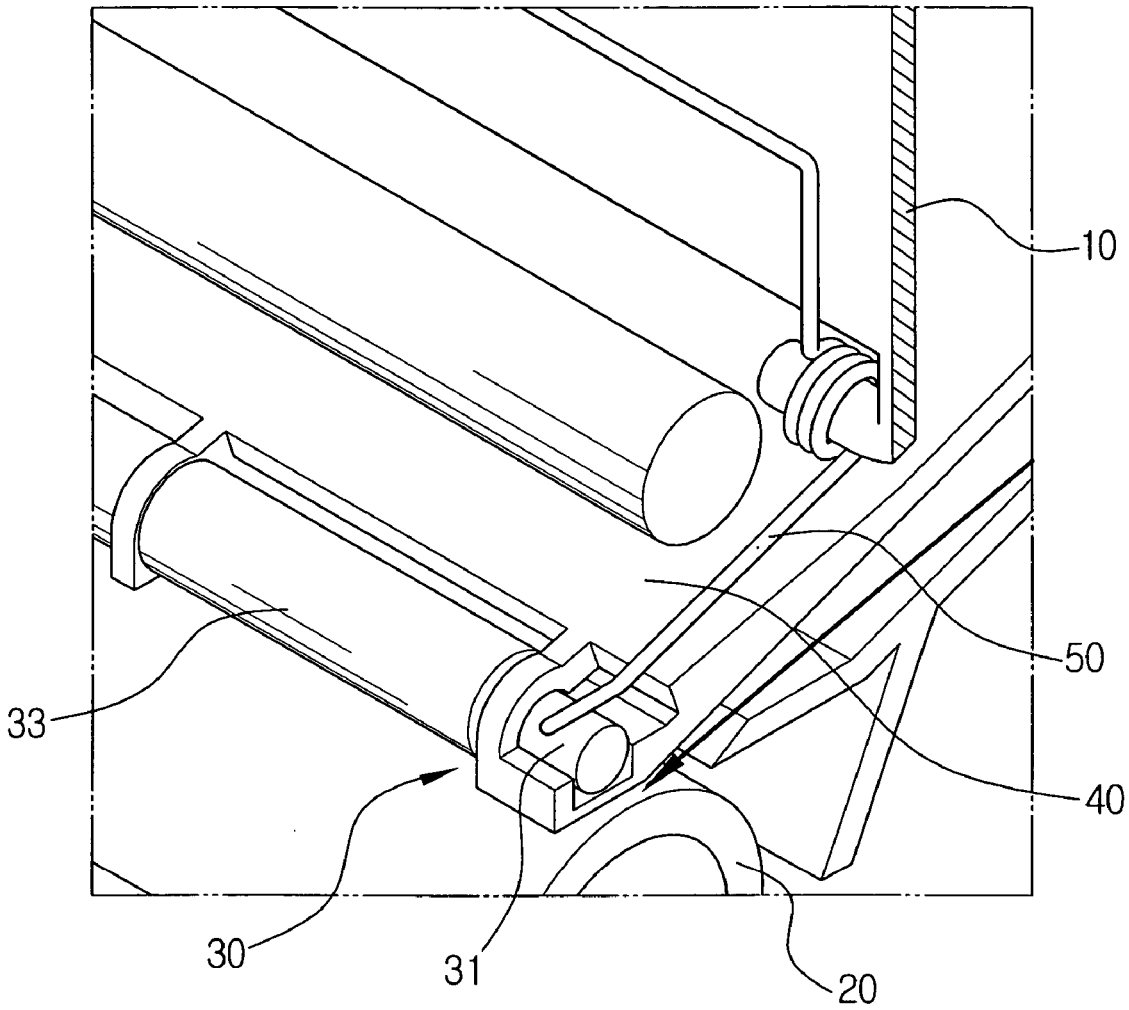
FIG. 2 is a perspective view showing a portion of FIG. 1.

Referring to FIGS. 1 and 2, an apparatus to control static electricity for an inkjet printer according to an embodiment of the present invention includes a frame 10 having a paper-feeding portion 11 disposed at a lower portion thereof, a feeding roller 20 to convey paper fed from the paper-feeding portion 11 to be placed under a printer head 15*a*, a pinch roller 30 to convey the paper by rotating in contact with the feeding roller 20, a holder 40 on which the pinch roller 30 is rotatably supported, and a ground member 50 to control static electricity that occurs in the paper passing between the feeding roller 20 and the pinch roller 30.

The paper stacked on the paper-feeding portion 11 is picked up and is conveyed by a pick-up roller 12. Then, the paper is conveyed toward the feeding roller 20 and the pinch roller 30 along a paper path. The frame 10 is provided with a guide shaft 14 on which a carriage 13 is reciprocally disposed. In the carriage 13 is mounted an ink-cartridge 15 having the printer head 15*a* to print an image on the paper passing between the feeding roller 20 and the pinch roller 30. At this point, the frame 10 is grounded to a pressed portion (not shown) disposed in the ink-jet printer.

The feeding roller 20 is rotatably disposed in the frame 10. Also, the feeding roller 20 rotates in contact with the pinch roller 30 to supply the paper passing between the feeding roller 20 and the pinch roller 30 to the print head 15*a*. At this time, the feeding roller 20 is driven while being controlled by a driving force such that the paper is aligned and supplied at a desired speed.

The pinch roller 30 is disposed above the feeding roller 20 such that the pinch roller 30 rotates in contact with the feeding roller 20. Also, the pinch roller 30 is rotatably disposed on an end of the holder 40, which is supported by the frame 10. More specifically, the pinch roller 30 has a shaft 31 that is made of metallic material and is supported on the holder 30, and roller bodies 33 disposed along an outer circumference of the shaft 31. The roller bodies 33 are spaced from each other by a predetermined distance. Also, the roller bodies 33 may be molded portions that include conductive synthetic resin.

The ground member 50 controls the static electricity that occurs in the paper passing between the feeding roller 20 and the pinch roller 30. The ground member 50 may be a torsion spring that is disposed around the frame 10 and has one end elastically contacting the shaft 31 and the other end elastically contacting the frame 10. That is, the ground member 50 is structured such that a metallic wire is wound around the frame 10 to form a torsion spring having one end elastically contacting the shaft 31 and the other end elastically contacting the frame 10. There may be multiple ground members 50. Accordingly, since the ground member 50 maintains friction by elastically contacting the shaft 31 even when the shaft rotates, a grounding state is maintained.

According to the above-described structure, when static electricity occurs in the paper conveyed from the paper-feeding portion 11, the static electricity is electrically transmitted to the roller bodies 33 of the pinch roller 30 from the paper passing between the feeding roller 20 and the pinch roller 30. Then, the static electricity is transmitted to the outside through the shaft 31, the ground member 50 and the frame 10.

According to the apparatus to control static electricity in the inkjet printer as described above, the ground member 50 is connected to the pinch roller 30 contacting the feeding roller 20, allowing the paper to pass between the pinch roller 30 and the feeding roller 20. Thus, the static electricity is electrically transmitted to the outside. Accordingly, since the static electricity is removed from the paper before it reaches the print head 15*a*, abnormalities of the print head that are caused by the static electricity are prevented, and thus the printing operation is properly performed.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. An apparatus to control static electricity in an ink-jet printer, comprising:

a print head;

a paper-feeding portion from which paper is fed;

a feeding roller to convey the paper being fed from the paper-feeding portion to the print head;

a pinch roller to rotate in contact with the feeding roller, the pinch roller having a shaft;

a holder, the shaft of the pinch roller being rotatably supported on the holder;

a frame made of a metallic material, to support the holder; and a ground member to ground the pinch roller to the frame, to control the static electricity occurring in the paper passing between the feeding roller and the pinch roller, wherein the ground member is a torsion spring that is wrapped around the frame and has a first end elastically contacting the pinch roller and a second end elastically contacting the frame.

2. The apparatus to control static electricity of claim 1, wherein the ground member is connected to the shaft of the pinch roller and the frame.

3. The apparatus to control static electricity of claim 1, wherein the ground member is metallic wire that has a first end connected to the shaft of the pinch roller and a second end connected to the frame.

4. An apparatus to control static electricity in an ink-jet printer, comprising:

a print head;

a paper-feeding portion from which paper is fed;

a feeding roller to convey the paper being fed from the paper-feeding portion to the print head;

a pinch roller to rotate in contact with the feeding roller, the pinch roller having a shaft;

a holder, the shaft of the pinch roller being rotatably supported on the holder;

a frame made of a metallic material, to support the holder; and a ground member to ground the pinch roller to the frame, to control the static electricity occurring in the paper passing between the feeding roller and the pinch roller wherein the ground member is a torsion spring that is wrapped around the frame and has a first end elastically contacting the pinch roller and a second end elastically contacting the frame, wherein the pinch roller is a molded portion including a conductive synthetic resin.

5. An apparatus, comprising:

first and second rollers to rotate in contact with each other to convey a printing medium;

a frame made of a metallic material, to support the rollers; and a ground member to ground the second roller to the frame, to control static electricity occurring in the paper passing between the first and second rollers, wherein the ground member is a torsion spring having an end elastically contacting the frame.

6. The apparatus of claim 5, further comprising:

a print head to print an image on the printing medium;

a feeding portion, the first and second rollers feeding the printing medium from the feeding portion to the print head.

7. The apparatus of claim 5, further comprising a plurality of the ground members.

8. A printer comprising:

a print head to print an image on a printing medium;

first and second rollers to rotate in contact with each other to convey the printing medium to the print head, static electricity being generated in the printing medium when passing between the first and second rollers;

a frame to support the rollers; and a torsion spring that is wrapped around the frame and contacting one of the rollers so that the static electricity is removed from the printing medium before being conveyed to the print head.

* * * * *

UNITED STATES PATENT AND TRADEMARK OFFICE

CERTIFICATE OF CORRECTION

PATENT NO. : 7,044,595 B2
APPLICATION NO. : 10/608183
DATED : May 16, 2006
INVENTOR(S) : Karp-sik Youn It is certified that error appears in the above-identified patent and that said Letters Patent is hereby corrected as shown below:

Title Page, Item (57) (Abstract), Line 1, change “inkjet” to --ink-jet--.

Column 4, Line 2, after “is” insert --a--.

Signed and Sealed this

Twenty-first Day of November, 2006

JON W. DUDAS
*Director of the United States Patent and Trademark Office*